US009651033B2

(12) United States Patent
Pirri et al.

(10) Patent No.: US 9,651,033 B2
(45) Date of Patent: May 16, 2017

(54) PUMPING UNIT FOR A MACHINE TO DISTRIBUTE CONCRETE

(75) Inventors: Nicola Pirri, Milan (IT); Gennaro Paolo Bottino, Milan (IT)

(73) Assignee: CIFA SPA, Senago (MI) (IT)

( * ) Notice: Subject to any disclaimer, the term of this patent is extended or adjusted under 35 U.S.C. 154(b) by 287 days.

(21) Appl. No.: 13/813,811

(22) PCT Filed: Aug. 1, 2011

(86) PCT No.: PCT/IB2011/001763
§ 371 (c)(1),
(2), (4) Date: Feb. 1, 2013

(87) PCT Pub. No.: WO2012/017287
PCT Pub. Date: Feb. 9, 2012

(65) Prior Publication Data

US 2013/0129534 A1 May 23, 2013

(30) Foreign Application Priority Data

Aug. 3, 2010 (IT) ..... MI2010A1482

(51) Int. Cl.
*F04B 1/02* (2006.01)
*F04B 15/02* (2006.01)

(52) U.S. Cl.
CPC ..... *F04B 1/02* (2013.01); *F04B 15/02* (2013.01); *F04B 15/023* (2013.01);
(Continued)

(58) Field of Classification Search
CPC ..... F04B 15/02; F04B 49/06; F04B 39/08; F04B 5/02
(Continued)

(56) References Cited

U.S. PATENT DOCUMENTS 3,647,325 A * 3/1972 Johnson ..... F01L 25/08 417/454
5,388,965 A * 2/1995 Fehn ..... F04B 13/00 417/63

(Continued)

FOREIGN PATENT DOCUMENTS

EP 1225426 A2 7/2002

OTHER PUBLICATIONS

Int'l Search Report and Written Opinion issued Feb. 9, 2012 in Int'l Application No. PCT/IB2011/001763.

*Primary Examiner* — William H Rodriguez
*Assistant Examiner* — Christopher Brunjes
(74) *Attorney, Agent, or Firm* — Panitch Schwarze Belisario & Nadel LLP

(57) ABSTRACT

A pumping unit for a machine to distribute concrete includes a pair of cylinders provided with a relative pumping piston movable linearly for a determinate travel to feed the concrete to a determinate circuit to distribute the concrete; and a hydraulic command circuit operatively connected to both the cylinders, to determine an alternate pumping movement of the relative pumping pistons. The pumping unit includes at least a sensor member operatively associated to at least one of the cylinders in order to detect point-by-point one or more data relating to the operating condition of the pumping piston during its movement for the whole travel. The data includes at least one of position, speed, stress and direction of movement of the relative piston.

9 Claims, 1 Drawing Sheet

(52) U.S. Cl.
CPC ... *F04B 2201/02* (2013.01); *F04B 2201/0201* (2013.01); *F04B 2201/0202* (2013.01); *F04B 2201/0204* (2013.01)

(58) Field of Classification Search
USPC ..... 417/18, 20–22, 515, 516, 531, 532; 324/207.11, 207.22, 207.23, 207.26
See application file for complete search history.

(56) References Cited

U.S. PATENT DOCUMENTS

| | | | | |
|---|---|---|---|---|
| 2005/0152787 | A1* | 7/2005 | Oglesby | 417/18 |
| 2008/0022672 | A1* | 1/2008 | He | F15B 15/18 60/413 |
| 2009/0220358 | A1 | 9/2009 | Krivsky et al. | |
| 2009/0288554 | A1* | 11/2009 | Sall | G01D 5/485 92/5 R |

* cited by examiner

PUMPING UNIT FOR A MACHINE TO DISTRIBUTE CONCRETE

CROSS-REFERENCE TO RELATED APPLICATIONS

This application is a Section 371 of International Application No. PCT/IB2011/001763, filed Aug. 1, 2011, which was published in the English language on Feb. 9, 2012, under International Publication No. WO 2012/017287 A2 and the disclosure of which is incorporated herein by reference.

BACKGROUND OF THE INVENTION

The present invention concerns a pumping unit for a machine to distribute concrete, such as for example a concrete mixer, a truck-transported pump or other suitable apparatus to distribute concrete during building operations. In particular the present invention concerns a pumping unit which is electronically controlled to optimize the pumping and delivery conditions of the concrete.

Pumping units are known which are operatively installed in machines to distribute concrete, such as for example a concrete mixer, a truck-transported pump or other, which include at least a pumping member of the double piston type, in which a hydraulic circuit alternatively commands the pistons of each cylinder to introduce the concrete into a relative distribution circuit.

In particular, in known solutions, end-of-travel detectors are associated to each cylinder, which detect the limit position of the pistons so as to influence a consequent inversion of command of the hydraulic circuit and therefore, to determine the operating alternation of the two pistons. In this way, when one of the two pumping pistons is pushing the concrete toward the delivery valve, the other is filling up with concrete. When they have reached the end of travel, the two pistons invert their movement in order to effect the inverse cycle of delivery/filling.

In this type of known solution, the end-of-travel detectors emit a signal only when the piston has already reached the end of travel and is ready to invert its movement.

Therefore, each pumping piston stops in a substantially abrupt manner in correspondence to the end-of-travel position, the command of the hydraulic circuit is inverted and the piston starts off again at an equal speed and in an opposite direction to that in which it arrived.

This known operating condition is the cause of great noisiness and considerable vibrations, with consequent great mechanical stresses of the components, increased wear and reduction of the overall lifespan.

Moreover, as the hydraulic circuit is commanded by a combustion engine, the abrupt inversions required for the operating alternation of the pistons and the torques required to actuate this operation, cause strong variations and oscillations of the revolutions of the combustion engine, and may cause damage thereto.

A further drawback of the known solutions is the fact that, since they detect only the end-of-travel position, there is no control of the actual position of the pistons, and therefore there are difficulties in the timing of the pistons and difficulties for the fluidity of delivery of the concrete.

Document U.S. Pat. No. 5,388,965 describes a pumping cylinder including a sensor to detect one or more data relating to its functioning condition.

One purpose of the present invention is to make a pumping unit for a machine to distribute concrete which allows to reduce to a minimum the noise and vibrations.

Another purpose of the present invention is to make a pumping unit which allows to limit the oscillations of the combustion engine of the relative hydraulic command circuit depending on the torque and power required.

Further purpose of the present invention is to make a pumping unit which has easier maintenance and setting-up steps compared with the teachings of the state of the art.

A further purpose is to make a pumping unit which allows an automatic timing of the pumping pistons.

The Applicant has devised, tested and embodied the present invention to overcome the shortcomings of the state of the art and to obtain these and other purposes and advantages.

BRIEF SUMMARY OF THE INVENTION

The present invention is set forth and characterized in the independent claim, while the dependent claims describe other characteristics of the invention or variants to the main inventive idea.

In accordance with the above purposes, a pumping unit for a machine to distribute concrete, according to the present invention, includes at least a pair of cylinders, each of which is provided with a relative pumping piston. Each pumping piston actuates a linear movement of alternate motion to feed the concrete to a determinate distribution circuit of the concrete.

In particular, the two pumping pistons cooperate with each other in order to carry out a substantially continuous circle of concrete delivery, alternating their respective delivery/filling up movements in the respective chambers with the concrete to be delivered.

The pumping unit also includes at least a hydraulic command circuit, or main circuit, operatively connected to both cylinders, and able to determine an alternate pumping movement of the pumping pistons.

The pumping unit according to the present invention also includes at least a sensor member operatively associated to at least one of the cylinders in order to detect at different points one or more data relating to the operating condition of the pumping piston during the whole travel of its movement.

Here and hereafter in the description and in the claims, by the expression "data relating to the operating condition of the pumping piston" we mean data such as the position, the speed, the acceleration, the stress, the direction of movement and others.

According to an advantageous variant of the present invention, two sensor members are provided, each of which is associated to a relative cylinder, so as to detect, in an independent manner, the data relating to the operating condition of each pumping piston.

With the present invention we therefore have the possibility of controlling the pumping piston or pistons at any moment during their operating travel, thus having a constant, point-by-point and substantially continuous control of their operations and therefore of the pumping conditions of the concrete.

In particular, thanks to the presence of a hydraulic block for the introduction/discharge of hydraulic fluid, which is connected hydraulically to the chamber of at least one of the pumping pistons in order to define an auxiliary hydraulic circuit, and thanks to the point-by-point signals which are obtained continually by the relative sensors, the invention allows to intervene directly on the pumping pistons, pumping hydraulic fluid or discharging hydraulic fluid from the circuit, so as to optimize the functioning of the pistons, and in particular their phasing. In particular, the hydraulic block, which intervenes selectively in addition on the main hydraulic command circuit of the pistons, allows to optimize, in a point-by-point manner, the volume of fluid contained in each of the cylinder chambers and therefore allows to optimize the performance of the pumping unit, based on the instantaneous and point-by-point signals detected by the sensors relating to the behavior of the pumping pistons.

In this way, it is possible to actuate a precise and correct management of the braking and re-starting of the pumping pistons for each pumping cycle. Indeed, using the data detected by the sensor members, it is possible to intervene on the hydraulic command circuit in order to opportunely slow down the pumping pistons when they are near their end of travel, and invert the direction of their movement in a coordinated manner, obtaining an optimal synchronism of the respective movements.

Thanks to the presence of the sensors and of the auxiliary hydraulic command block, it is possible to obtain both a reduction in the noise and vibrations of the pumping unit due to the impact of the pumping pistons when they reach the end of travel, and also a regularization of the flow of concrete in the pipes, and, consequently, less stress on the supports of the pipes of the concrete.

Moreover, thanks to the point-by-point information relating to the position of the pumping pistons along the whole of their travel, it is possible to guarantee that each pumping piston carries out its travel completely, independently of the different command conditions of the main hydraulic command circuit, such as for example speed, pressure, inertia, viscosity of the oil or other.

The Applicant has found that by slowing down each of the pumping pistons according to a curve which takes account of factors such as the position, the speed, the flow rate of the concrete or others, the efficiency of the pumping unit is increased, keeping it constantly at its maximum functioning values and therefore increasing its performance.

According to a variant, the hydraulic command circuit includes a hydraulic pipe fluidically connected to the cylinders, and a pumping member provided with one or more bi-directional or mono-directional pumps, able to feed the hydraulic pipe alternately in one direction and the other, and a motor member operatively connected to the pump/pumps, and able to command the feed of the hydraulic command circuit.

The hydraulic circuit also includes the auxiliary hydraulic block which selectively intervenes to selectively introduce/discharge hydraulic fluid into/from the chamber of the cylinders based on the information received from the sensors associated to the pumping pistons.

Using the present invention, it is possible to stabilize the revolutions of the motor member also during the inversions of travel of the pumping pistons and the feed of the hydraulic command circuit.

Indeed, since we know the position of the pumping pistons, it is possible to foresee the instant in which the inversions will be made, so as to opportunely command the rotation speed of the motor member and reduce the oscillations of its revolutions.

Moreover, with the solution according to the present invention it is possible to reduce the times and the costs of intervention and maintenance. For example, using the data relating to the operating condition of each pumping piston, it is possible to actuate a rapid change thereof, since it is possible to move them into any position selected by the operator, and therefore convenient for the intervention of the latter.

A further advantage of the solution according to the present invention is that, since we know the point-by-point data relating to the operating condition of each pumping piston, it is possible to actuate a substantially automatic phasing of the pumping pistons themselves.

Indeed the sensor members, detecting the data over the whole length of the travel of the pumping pistons, allow to verify the actual travel and therefore to operate so as to phase the two pumping pistons by intervening on the hydraulic command circuit and on the auxiliary hydraulic block, with commands given to the hydraulic block which selectively introduces/discharges hydraulic fluid, in order to vary the command conditions of each pumping piston.

This allows to obviate the phase shift problems of the pumping pistons which can happen when the pumping unit is in use and which are, in the state of the art, the cause of a more or less perceptible loss of efficiency of the pumping unit and therefore of the quantity of concrete actually pumped.

A further advantage given by the point-by-point control over the whole travel of each pumping piston is that the user of the pumping unit can verify at any moment the real position of the pumping pistons and as a consequence can identify not only any problems but also the position of the problems. For example, a pumping piston which slows down or blocks in a certain position may indicate a localized problem which makes a speedy solution thereof both more simple and economical.

According to another variant, the sensor member includes a single position transducer which identifies, at every instant and over the whole travel, the actual position of each pumping piston.

According to another variant, the sensor member includes two or more sensors, for example transducers, capacitive, volumetric, thermal or pressure sensors, disposed along the travel of each pumping piston in order to identify point-by-point said data relating to the operating condition of each pumping piston.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

To facilitate comprehension, the same reference numbers have been used, where possible, to identify identical common elements in the drawings.

DETAILED DESCRIPTION OF THE INVENTION

Figure 1:
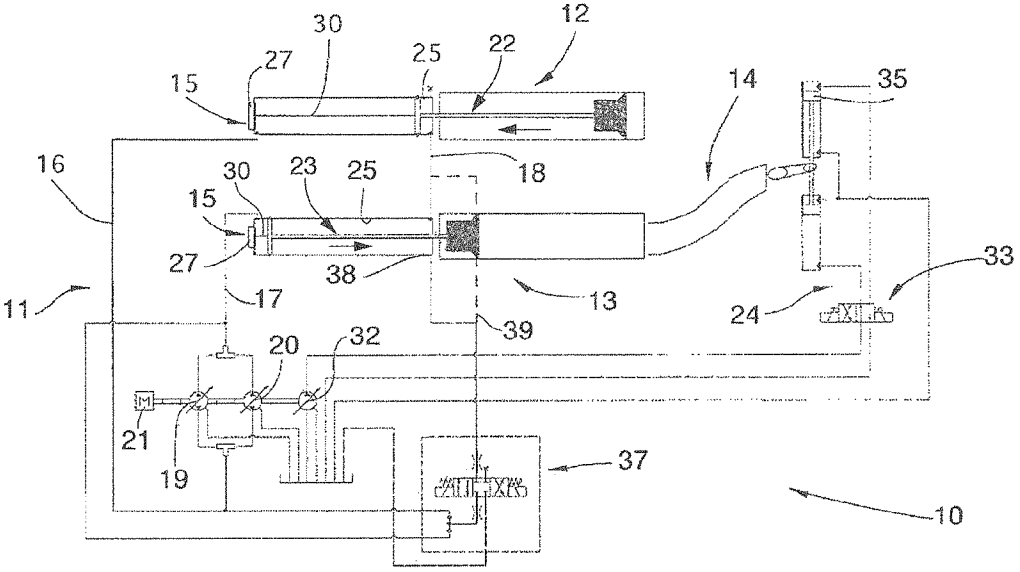
FIG. 1 schematically shows a pumping unit according to the present invention.

With reference to FIG. 1, a pumping unit 10 is shown in its entirety, of the type which can be used in a machine for the distribution of concrete, such as for example a concrete mixer, a truck-transported pump or other apparatus typically used in building sites to make concrete constructions.

The pumping unit 10 according to the present invention includes a hydraulic command circuit 11, a pair of pumping cylinders, respectively a first 12 and a second 13, a feed terminal 14 to feed the concrete toward a relative concrete distribution circuit, of the known type and not shown, and an exchange circuit 24, operatively associated to the feed terminal 14.

The pumping unit 10 also includes two sensor members 15 operatively associated to each of the two pumping cylinders 12 and 13, the functions of which will be explained in detail hereinafter.

The hydraulic command circuit 11 in this case is of the oil-dynamic type and includes a first feed pipe 16, a second feed pipe 17, two bi-directional feed pumps 19 and 20 and a motor member 21.

The first feed pipe 16 is structured to fluidically connect the feed pumps 19 and 20 with the first pumping cylinder 12.

The second feed pipe 17 is structured to fluidically connect the bi-directional pumps 19 and 20 with the second pumping cylinder 13.

The two bi-directional feed pumps 19 and 20 are structured to alternately direct the oil-dynamic flow toward the first feed pipe 16, or toward the second feed pipe 17, so as to condition the alternate actuation of the first pumping cylinder 12 and the second pumping cylinder 13.

Each pumping cylinder 12 and 13 includes a pumping piston, respectively a first 22 and a second 23, each able to slide inside a relative chamber 25, for a determinate travel S.

The linear movement of each pumping piston 22, 23 as far the speed, the pressure and the direction of actuation are concerned, is commanded, as we said, by the hydraulic command circuit 11, or main circuit.

To close the hydraulic command circuit 11, a connection pipe 18 is provided disposed in a fluid dynamic connection between the two pumping cylinders 12 and 13.

In particular the connection pipe 18 puts in communication the chambers 25 of the cylinders where the pistons 22, 23 move in alternate motion.

To optimize the performance of the pumping unit 10, the volume of fluid contained in the chambers 25 of the pistons connected by the pipe 18 must have a precise and constant value depending on the size of the pistons 22, 23.

This volume, thanks to the presence of the sensor members 15, can be detected continuously by the system in a point-by-point manner. It is therefore possible to intervene at any moment to restore the correct value by the aid of a hydraulic block 37, dedicated for this function.

In particular, the hydraulic block 37 is suitable to remove/introduce oil, at a sufficient pressure, in a point-by-point manner and in any case able to optimize the performance of the pumping unit 10 based on the detections supplied by the sensors 15.

The fluid used to restore the correct value can be introduced into/removed from the chambers 25 of the cylinders by directly exploiting the mouth 38 present on the chamber 25 of the lower cylinder, in FIG. 1, or by inserting a branch 39 on the connection pipe 18.

An auxiliary circuit is thus made which, based on the commands from the sensors 15, determines the introduction/discharge of fluid into/from the chambers 25 thanks to the selective activation of the hydraulic block 37, so as to optimize at every moment the behavior of the pumping pistons 22, 23.

The bi-directional pumps 19 and 20 are of the variable volume type, both commanded by the motor member 21 which can be a combustion engine of the Diesel type or other, of a substantially traditional type.

Advantageously, the two bi-directional pumps 19 and 20 are connected to a power adjuster set to about 60-80 kw, and a pressure cut of about 340-360 bar.

Figure 2:
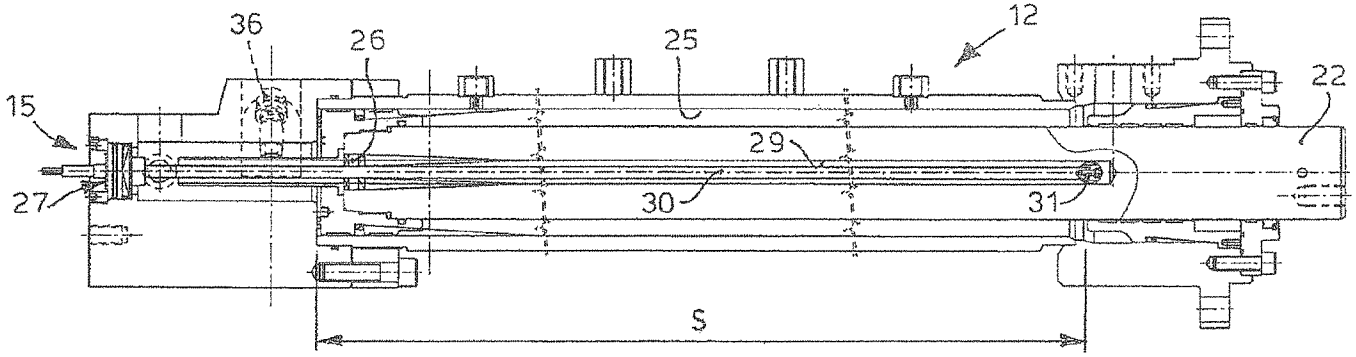
FIG. 2 is a cross section of an enlarged detail in FIG. 1.

In the form of embodiment shown as a non-restrictive example in the drawings, each sensor member 15 includes a slider element 26 (FIG. 2) mounted solid and on board the relative pumping piston 22, 23, and a detector element 27 mounted on the relative cylinder 12, 13, in a fixed position with respect to the pumping piston 22, 23.

In this case, each pumping piston 22, 23 has a blind axial hole 29 which is open toward the outside on the side opposite the end suitable to act on the concrete.

The slider element 26 includes an annular magnet disposed inside the axial hole 29 at a distance from the blind bottom at least equal to the travel S of the pumping piston 22, 23.

The detector element 27 includes a shaft 30 fed electrically and disposed with play inside the axial hole 29. The shaft 30 is conformed and disposed so that the magnet of the slider element 26 is also outside and in a condition substantially surrounding the shaft 30, so that the magnetic field of the magnet generates an induced current on the shaft 30.

In this way, the movement of the pumping piston 22, 23, and therefore of the slider element 26 with respect to the shaft 30, determines a movement of the magnetic field generated by the magnet along the travel S of the cylinder and along the length of the shaft 30.

This movement determines a variation in the position of the magnetic field generated by the magnet with respect to the shaft 30 and therefore the detection of a different induced current on the shaft 30.

The variation in the induced current detected on the shaft 30 is translated by the detector element 27 in terms of variation of the position of the slider element 26 with respect to the shaft 30; it is therefore possible to obtain data relating to the actual position, speed, acceleration and other of the relative pumping piston 22, 23.

Advantageously, the shaft 30 includes a support push rod 31 with sizes correlated to the axial hole 29 and able to support the shaft 30, keeping it in a substantially linear position inside the axial hole 29, that is, without interference with the outside walls of the latter.

In this case, an end-of-travel sensor 36 is also associated to each pumping cylinder 12, 13, which assists the system to command the operative inversion both of the bi-directional pumps 19 and 20 and also of the exchange circuit 24, and therefore of the feed terminal 14.

The feed terminal 14 is of the substantially traditional type and is known in jargon by the term "S" valve. The feed terminal 14 is alternately moved by the exchange circuit 24, in a coordinated manner to the movement of the two pumping pistons 22 and 23.

The exchange circuit 24 traditionally includes a mono-directional pump 32, a directional valve 33, and a pair of exchange cylinders 35, hydraulically connected with each other.

The mono-directional pump 32 has a variable volume, is commanded by the same motor member 21 as the two bi-directional pumps 19 and 20, and is pressure adjusted. In particular, when a determinate pressure value is reached in the exchange cylinders 35 the volume of the pump 32 is reduced to its minimum value with the sole function of compensating the oil leaks. The value of this pressure is variable between about 120 bar and about 200 bar.

The directional valve 33 is a 4/2 valve with electro-hydraulic command with detention of the position, and is able to alternately exchange the flow of oil entering the exchange cylinders 35, until these determine the alternate movement of the feed terminal 14.

The exchange command of the directional valve 33 occurs in a coordinated manner to the frequency of operative alternation of the pumping pistons 22 and 23, and is subject to possible operative variations defined by the effect of the data detected by the sensor member 15.

In FIG. 1 the discharge lines of both the command circuit 11 and the exchange circuit 24 are represented by a dotted line.

It is clear that modifications and/or additions of parts may be made to the pumping unit 10 as described heretofore, without departing from the field and scope of the present invention.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A pumping unit for a machine to distribute concrete, the pumping unit comprising:

at least a pair of cylinders (12, 13) provided with a relative pumping piston (22, 23) movable linearly in relative chambers (25) of the cylinders for a determinate travel (S) and able to feed the concrete to a determinate circuit to distribute the concrete, a main hydraulic command circuit (11) operatively connected to both the cylinders (12, 13), and able to determine an alternate pumping movement of the relative pumping piston (22, 23), at least one sensor member (15) operatively associated with at least one of said cylinders (12, 13) in order to detect, at every instant on the whole travel (S), one or more data relating to the operating condition of said pumping piston (22, 23) during its movement, wherein said data comprise at least one of position, speed, stress and direction of movement of the relative piston (22, 23), a connection pipe (18) which connects the relative chambers (25) of the cylinders with respect to each other, and a hydraulic block (37) directly hydraulically connected to at least one of said chambers (25) and to said connection pipe (18) connecting the relative chambers (25), thereby defining an auxiliary hydraulic circuit which selectively introduces/discharges hydraulic fluid into/from the chambers (25) of said pumping cylinders (12, 13), in addition to the main hydraulic circuit, based on the signals being detected and transmitted to the hydraulic block (37) by the at least one sensor member (15), wherein the hydraulic block optimizes, in a continuous manner, the volume of hydraulic fluid contained in each of the chambers (25) of the cylinders connected by the connection pipe (18) and the performance of the pumping unit.

2. The pumping unit as claimed in claim 1, wherein the at least one sensor member (15) comprises two sensor members (15), each of which is associated to a relative cylinder (12, 13), so as to detect, in an independent manner, the data relating to the operating condition of each pumping piston (22, 23) for the whole travel.

3. The pumping unit as claimed in claim 1, wherein the hydraulic unit (11) comprises a hydraulic pipe (16, 17, 18) fluidically connected to the cylinders (12, 13), means able to command the selective inversion of hydraulic command of the pistons (12, 13), and a pumping member (19, 20) able to command the feed of said hydraulic pipe (16, 17, 18).

4. The pumping unit as claimed in claim 1, wherein the at least one sensor member (15) is a single sensor position transducer which identifies the actual position of each pumping piston (22, 23).

5. The pumping unit as claimed in claim 4, wherein each of the at least one sensor member (15) comprises a slider element (26) mounted with and aboard the relative pumping piston (22, 23), and a detector element (27) mounted on the relative cylinder (12, 13), in a fixed position with respect to said pumping piston (22, 23).

6. The pumping unit as claimed in claim 5, wherein each pumping piston (22, 23) comprises a blind axial hole (29) which is open toward the outside on the side opposite to the end suitable to act on the concrete, and wherein the slider element (26) comprises an annular magnet disposed inside the axial hole (29) at a distance from the blind bottom at least equal to the travel (S) of the pumping piston (22, 23).

7. The pumping unit as claimed in claim 6, wherein the detector element (27) comprises a shaft (30) positioned with play inside the axial hole (29) so as to cover the whole travel (S) of the relative pumping piston (22, 23) and conformed and disposed so that the magnet of the slider element (26) is in a condition substantially surrounding said shaft (30).

8. The pumping unit as claimed in claim 7, wherein the shaft (30) comprises a support push rod (31) with sizes correlated to the axial hole (29) and able to support said shaft (30) inside said axial hole (29).

9. The pumping unit as in claim 1, wherein each of the at least one the sensor member (15) is selected from the group consisting of two or more transducer sensors, capacitive sensors, volumetric sensors, thermal sensors, and pressure sensors, and wherein each of the at least one sensor members (15) is disposed along the travel (S) of each pumping piston (22, 23).

* * * * *